US012146724B2

(12) United States Patent
Beasley et al.

(10) Patent No.: US 12,146,724 B2
(45) Date of Patent: Nov. 19, 2024

(54) STOCK ADAPTER FOR A FIREARM

(71) Applicant: South Central Manufacturing Corporation, Summersville, MO (US)

(72) Inventors: Joseph S. Beasley, Summersville, MO (US); Albert Jakobus Hoffman, Rogersville, MO (US)

(73) Assignee: SOUTH CENTRAL MANUFACTURING CORPORATION, Summersville, MO (US)

( * ) Notice: Subject to any disclaimer, the term of this patent is extended or adjusted under 35 U.S.C. 154(b) by 0 days.

(21) Appl. No.: 18/221,121

(22) Filed: Jul. 12, 2023

(65) Prior Publication Data

US 2024/0019226 A1 Jan. 18, 2024

Related U.S. Application Data

(60) Provisional application No. 63/420,193, filed on Oct. 28, 2022, provisional application No. 63/388,665, filed on Jul. 13, 2022.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/04; F41A 11/04
USPC ..... 42/75.03, 73, 71.01
See application file for complete search history.

(56) References Cited

U.S. PATENT DOCUMENTS 5,235,771 A * 8/1993 Sokol ..... F41C 27/06 42/105
8,677,669 B1 * 3/2014 Vesligaj ..... F41C 23/12 42/75.01
11,609,066 B1 * 3/2023 Newby ..... F41C 23/04
2005/0268516 A1 * 12/2005 Nelson ..... F41G 1/00 42/73

(Continued)

OTHER PUBLICATIONS

Rellim Arms, LLC, "Rellim Arms Stock Adapters," https://www.rellimarms.com/stock-adapters, (c) 2022, Accessed Dec. 16, 2022.

(Continued)

*Primary Examiner* — Michael D David
(74) *Attorney, Agent, or Firm* — Bennet K. Langlotz; Langlotz Patent & Trademark Works, LLC

(57) ABSTRACT

Stock adapters for firearms have a first adapter portion having a firearm interface configured to removably connect to the stock interface of the firearm, the first adapter portion having a quick detach first adapter interface, a second adapter portion having a stock interface configured to removably connect to the firearm interface of the stock, the second adapter portion having a quick detach second adapter interface configured to removably connect to the firearm interface of the stock, and the first and second adapter interfaces being removably joined in an abutting condition, and when in the abutting condition relatively rotatable between an unlocked condition in which the first and second adapter interfaces are axially separable, and a locked condition in which the first and second adapter interfaces are axially inseparable. The first and second adapter interfaces may be rotationally aligned to rotationally interface about the barrel axis.

12 Claims, 13 Drawing Sheets

(56) References Cited

U.S. PATENT DOCUMENTS

| | | | | |
|---|---|---|---|---|
| 2006/0010746 | A1* | 1/2006 | Little | F41C 23/04 42/69.01 |
| 2013/0091751 | A1* | 4/2013 | Barney | F41C 23/10 42/71.01 |
| 2016/0061559 | A1* | 3/2016 | Wood | F41C 23/14 42/73 |
| 2019/0390933 | A1* | 12/2019 | Tran | F41C 23/04 |
| 2020/0278171 | A1* | 9/2020 | Peknik | F41C 23/04 |
| 2022/0333900 | A1* | 10/2022 | Beasley | F41G 11/003 |

OTHER PUBLICATIONS

Rellim Arms, LLC, "Rab-Ad Installation Inst[r]uctions," date of publication unknown.

* cited by examiner

STOCK ADAPTER FOR A FIREARM

CROSS-REFERENCE TO RELATED APPLICATION

This application claims the benefit of U.S. Provisional Patent Application No. 63/388,665 filed on Jul. 13, 2022, entitled "RAPID ATTACH BUTTSTOCK ADAPTER," which is hereby incorporated by reference in its entirety for all that is taught and disclosed therein. This application also claims the benefit of U.S. Provisional Patent Application No. 63/420,193 filed on Oct. 28, 2022, entitled "RAPID ATTACH BUTTSTOCK ADAPTER," which is hereby incorporated by reference in its entirety for all that is taught and disclosed therein.

FIELD OF THE INVENTION

The present invention relates to firearms, and more particularly to a stock adapter for a firearm that enables the user to quickly remove and reattach the stock of a firearm without any tools.

BACKGROUND AND SUMMARY OF THE INVENTION

Stocks provide many advantages to the user when they are installed on a firearm, such as a rifle or machine gun. Buttstocks enable the shooter to brace the firearm with their shoulder, which provides a stable firing platform to increase accuracy and absorb recoil forces. However, they significantly increase the overall length of the firearm, so it is desirable to remove them to save space in a gun case or safe when the firearm is stored. Furthermore, many users prefer to customize their firearm for different situations, which can include utilizing multiple stocks incorporating their desired buffer assembly and sling attachment points.

Thus, a need for a user to be able to quickly remove and reattach the stock of a firearm without tools has been recognized as a widespread need. One prior art example that attempts to meet this need is the Rellim Arms Stock Adapter manufactured by Rellim Arms, LLC of Wichita, KS, which is a tool-less device for connecting a stock to a firearm. The Rellim Arms Stock Adapter utilizes a sliding dovetail mount that requires the stock portion to be inserted into the receiver portion from above perpendicularly to the barrel axis. This approach is believed to have numerous disadvantages. This attachment maneuver requires careful application of force at the end of a lever arm and greater precision in alignment, which can be difficult to achieve in a stressful battle situation. The Rellim Arms Stock Adapter is also mechanically complex, which makes it more time-consuming and expensive to manufacture. Finally, the Rellim Arms Stock Adapter omits automatic retention of the spring-loaded buffer present in the host firearm when the Rellim Arms Stock Adapter is detached into its two components.

Therefore, a need exists for a new and improved stock adapter for a firearm that enables the user to quickly remove and reattach the stock of a firearm without any tools. In this regard, the various embodiments of the present invention substantially fulfill at least some of these needs. In this respect, the stock adapter for a firearm according to the present invention substantially departs from the conventional concepts and designs of the prior art, and in doing so provides an apparatus primarily developed for the purpose of enabling the user to quickly remove and reattach the stock of a firearm without any tools.

The present invention provides an improved stock adapter for a firearm, and overcomes the above-mentioned disadvantages and drawbacks of the prior art. As such, the general purpose of the present invention, which will be described subsequently in greater detail, is to provide an improved stock adapter for a firearm that has all the advantages of the prior art mentioned above.

To attain this, the preferred embodiment of the present invention essentially comprises a first adapter portion having a firearm interface configured to removably connect to the stock interface of the firearm, the first adapter portion having a quick detach first adapter interface, a second adapter portion having a stock interface configured to removably connect to the firearm interface of the stock, the second adapter portion having a quick detach second adapter interface configured to removably connect to the firearm interface of the stock, and the first adapter interface and second adapter interface being removably joined in an abutting condition, and when in the abutting condition relatively rotatable between an unlocked condition in which the first adapter interface and second adapter interface are axially separable, and a locked condition in which the first adapter interface and second adapter interface are axially inseparable. The first adapter interface and second adapter interface may be rotationally aligned to rotationally interface about the barrel axis. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
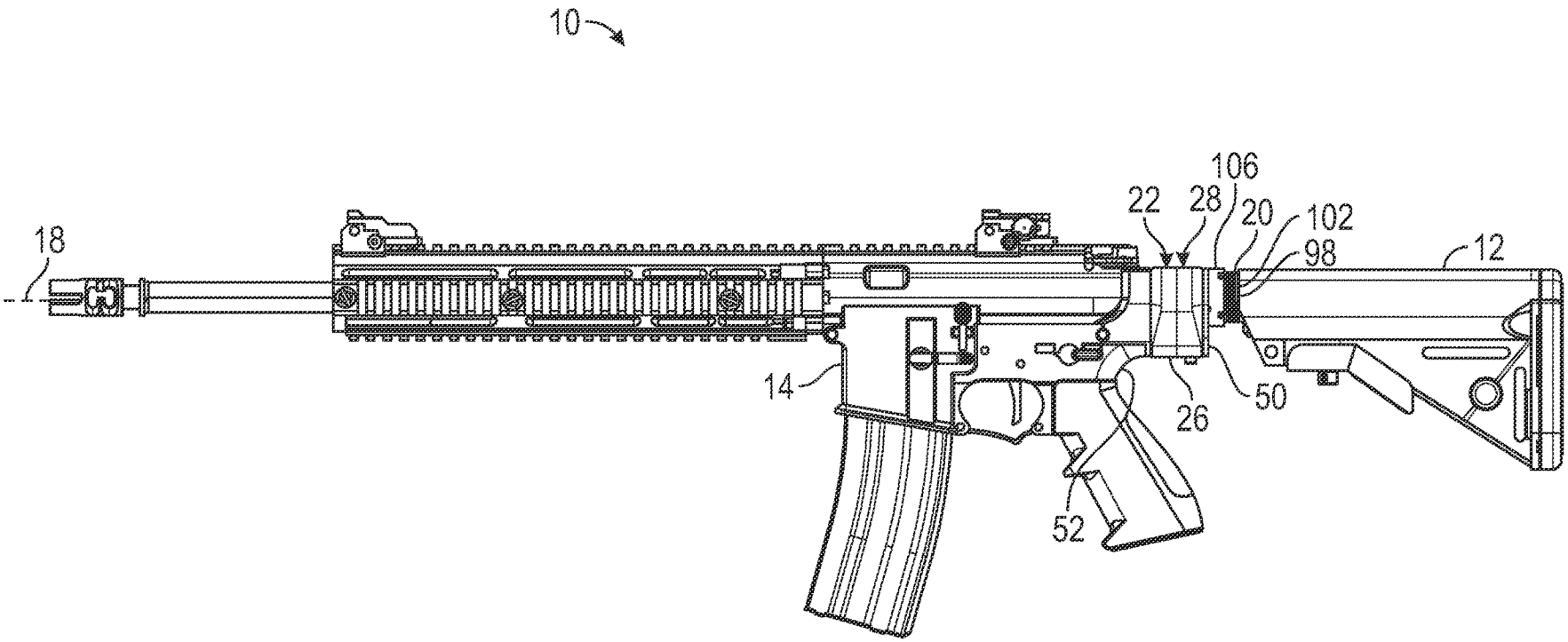
FIG. 1 is a side view of the current embodiment of a stock adapter for a firearm constructed in accordance with the principles of the present invention in use attaching a stock to a rifle.

An embodiment of the stock adapter for a firearm of the present invention is shown and generally designated by the reference numeral 10.

FIGS. 1-4B illustrate the improved stock adapter for a firearm 10 of the present invention. More particularly, FIG. 1 shows the stock adapter for a firearm in use connecting a stock 12 to a rifle 14. The rifle is an AR-type firearm having a stock interface 16 in the form of a threaded bore and defining a barrel axis 18 in the current embodiment. The stock has a firearm interface 20 in the form of a threaded portion configured to removably connect to the stock interface. The stock adapter for a firearm has a first adapter portion 22 having a firearm interface 24 configured to removably connect to the stock interface of the firearm. The first adapter portion also has a quick detach first adapter interface 26. The stock adapter for a firearm also has a second adapter portion 28 having a stock interface 30 in the form of a threaded bore configured to removably connect to the firearm interface of the stock. The second adapter portion also has a quick detach second adapter interface 32 configured to removably connect to the firearm interface of the stock.

Figure 5:
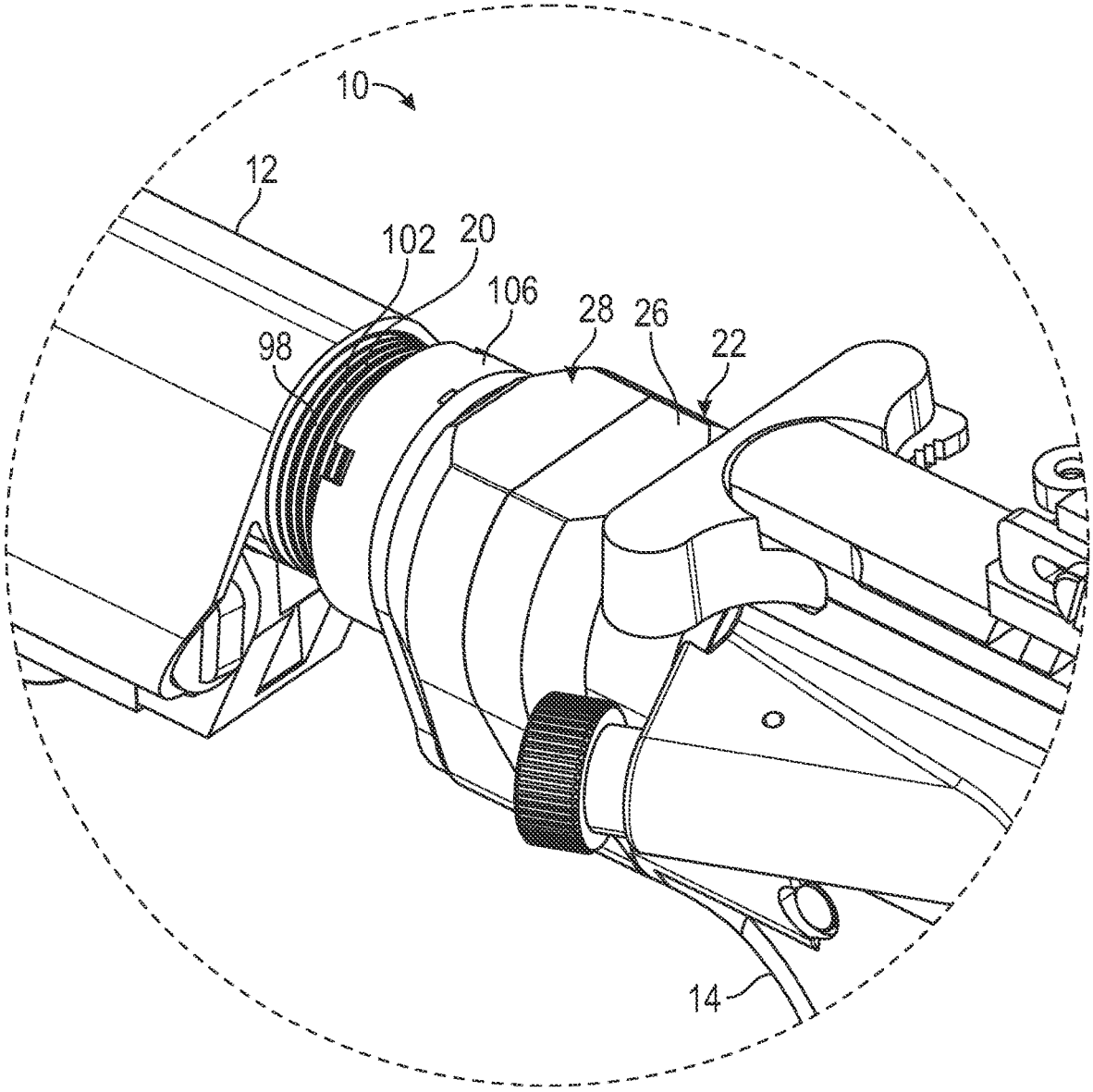
FIG. 5 is an isometric view of the stock adapter for a firearm of FIG. 1 in the locked condition.
Figure 6:
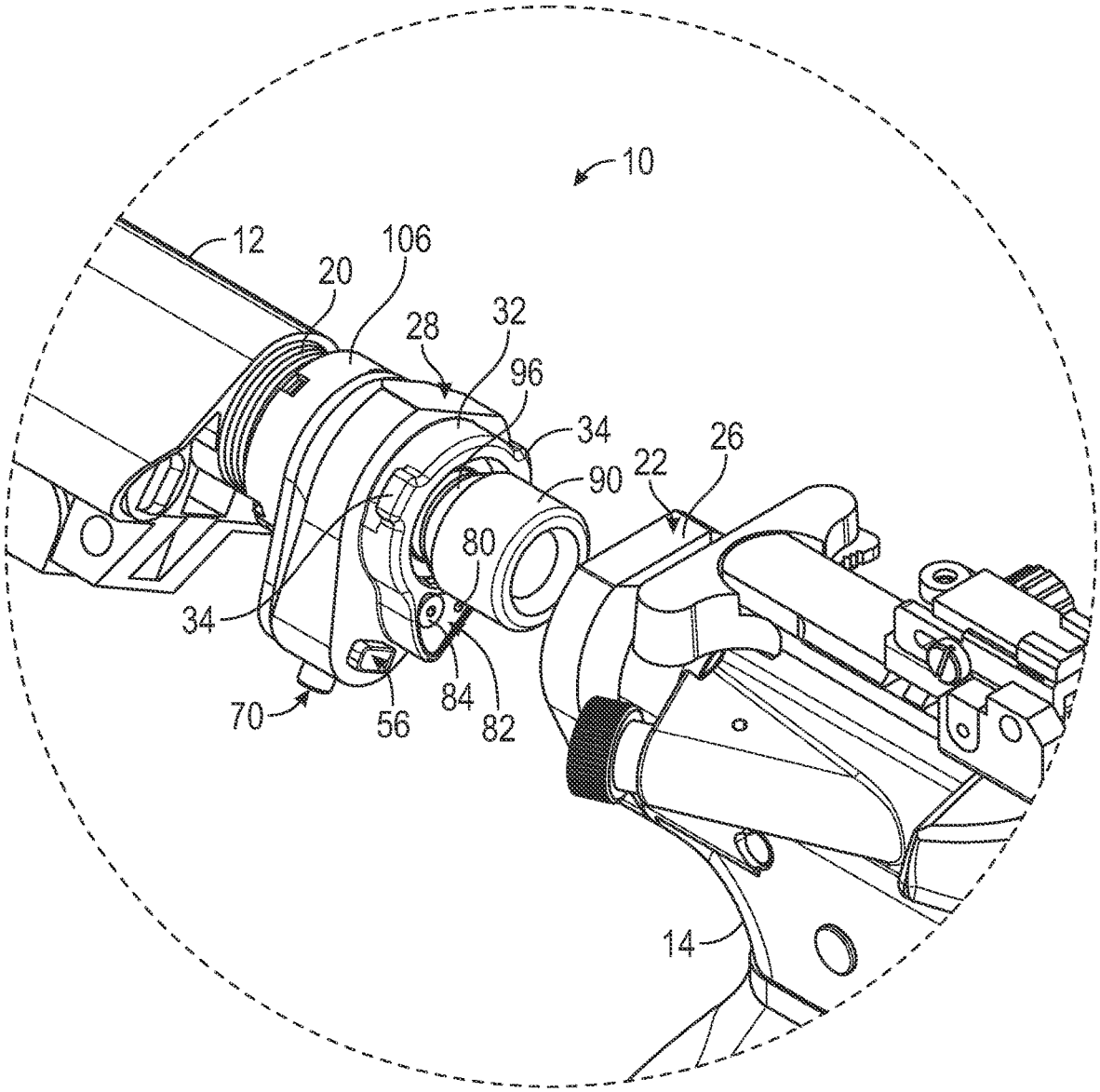
FIG. 6 is an isometric view of the stock adapter for a firearm of FIG. 1 in the unlocked and detached condition.
Figure 7B:
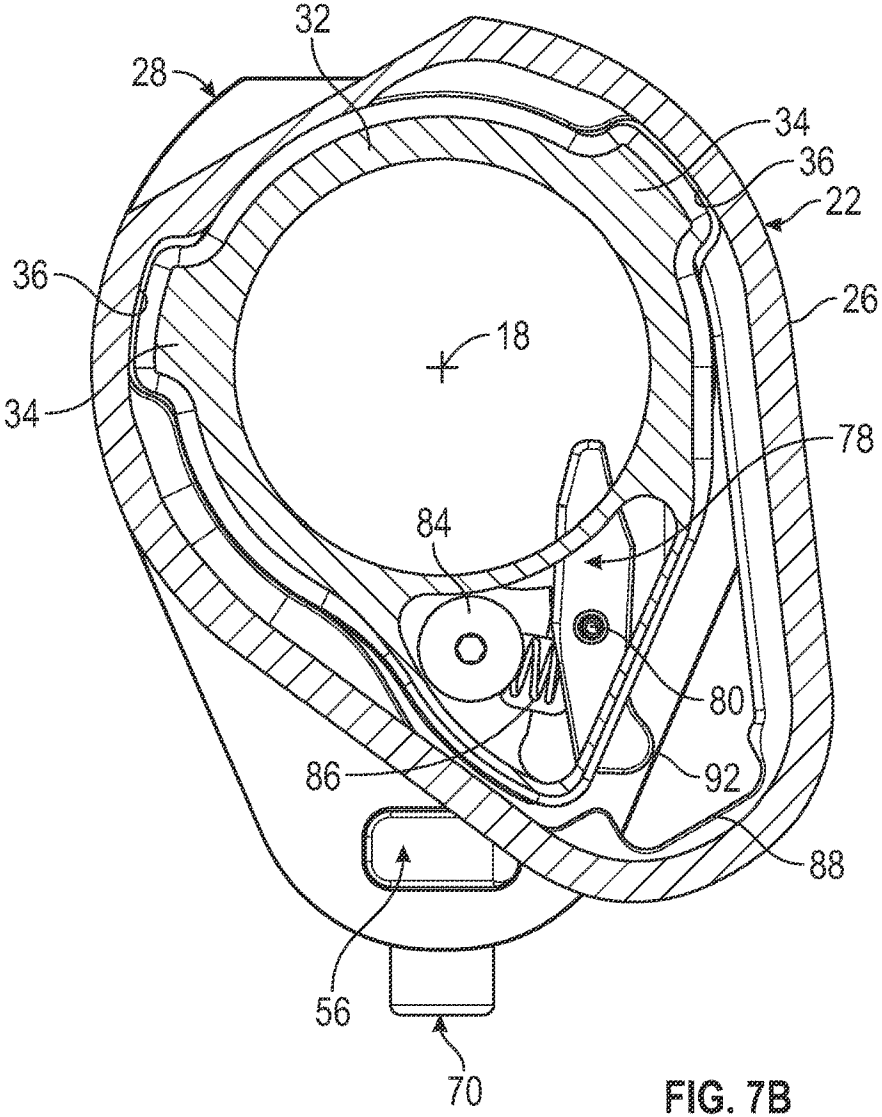
FIG. 7B is a front view of the second adapter portion of the stock adapter for a firearm of FIG. 1 with the latch in the released position.
Figure 7A:
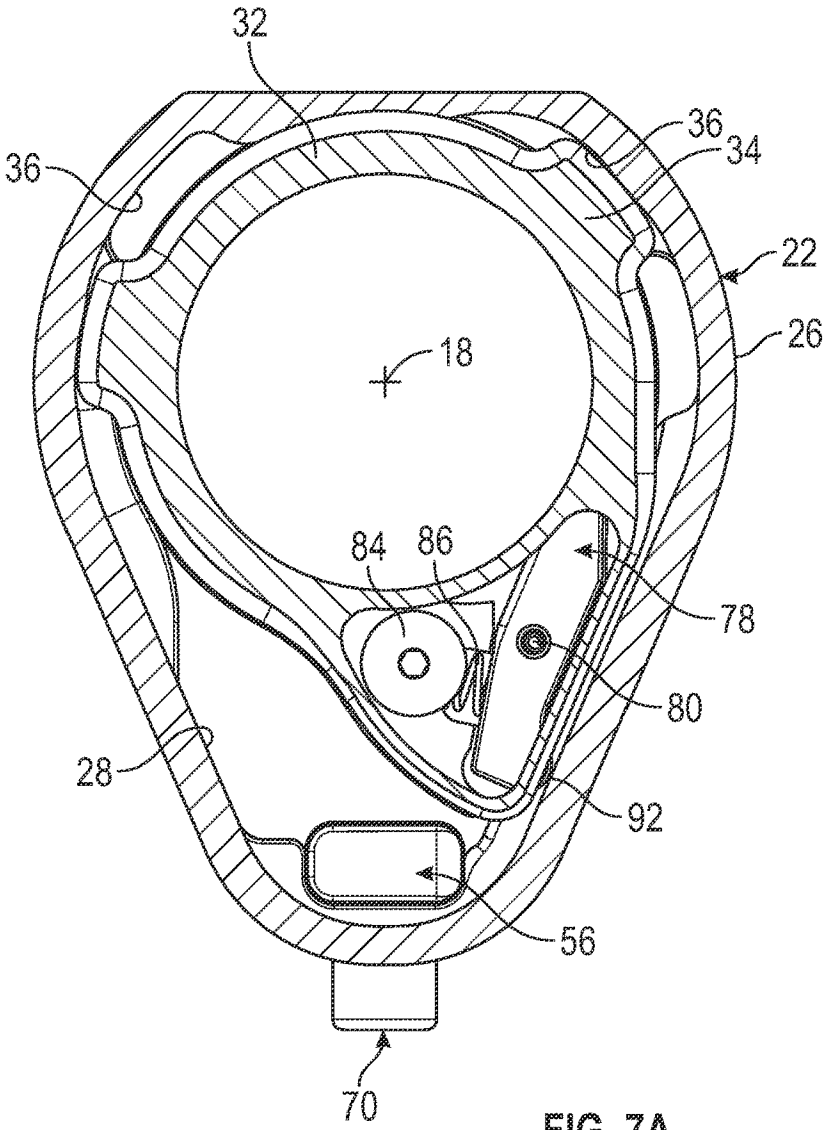
FIG. 7A is a front view of the second adapter portion of the stock adapter for a firearm of FIG. 1 with the latch in the retention position.

As is shown in FIGS. 5-7B, the first adapter interface 26 and second adapter interface 32 can be removably joined in an abutting condition and, when in the abutting condition, are relatively rotatable between an unlocked condition in which the first adapter interface and second adapter interface are axially separable (shown in FIGS. 6 & 7B), and a locked condition in which the first adapter interface and second adapter interface are axially inseparable (shown in FIGS. 5 & 7A). The first adapter interface and second adapter interface are rotationally aligned to rotationally interface about the barrel axis 18. In the current embodiment, rotation between the locked condition and unlocked condition is less than one half rotation.

Figure 2A:
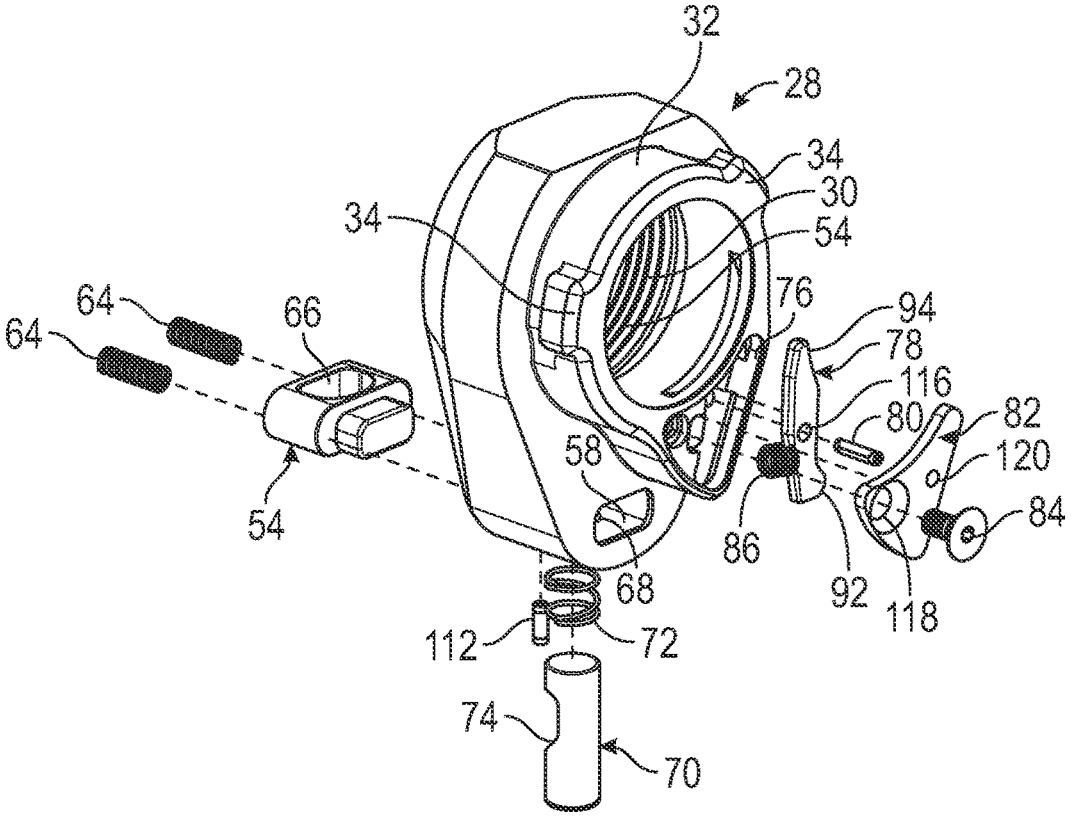
FIG. 2A is an exploded rear view of the stock adapter for a firearm of FIG. 1 detached from the rifle.
Figure 2A:
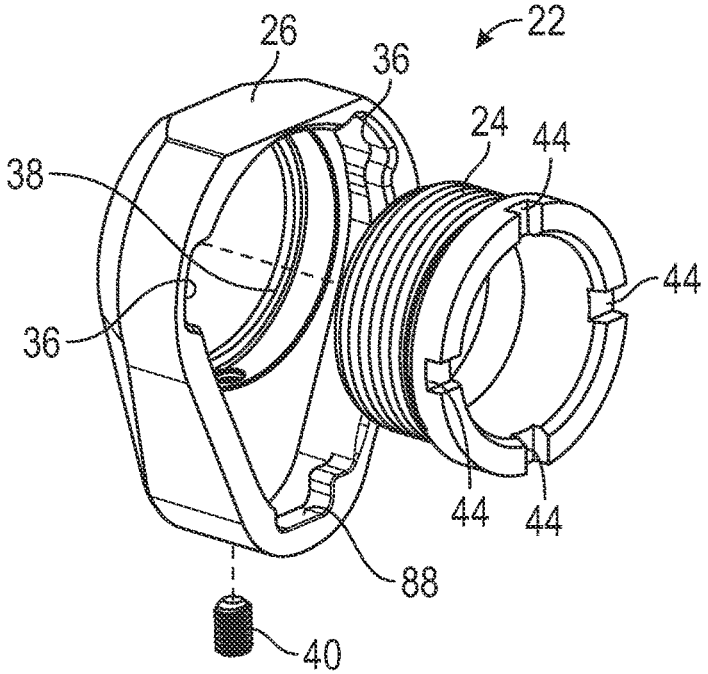
Figure 2B:
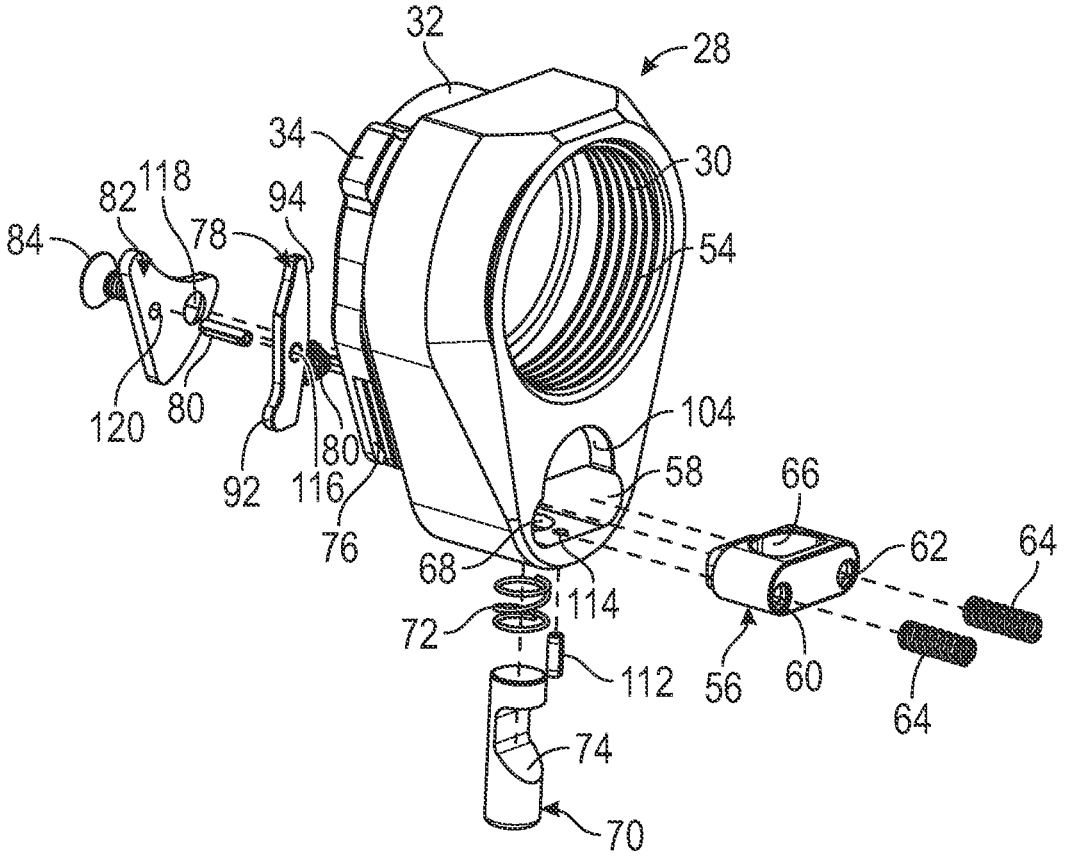
FIG. 2B is an exploded front view of the stock adapter for a firearm of FIG. 1 detached from the rifle.
Figure 2B:
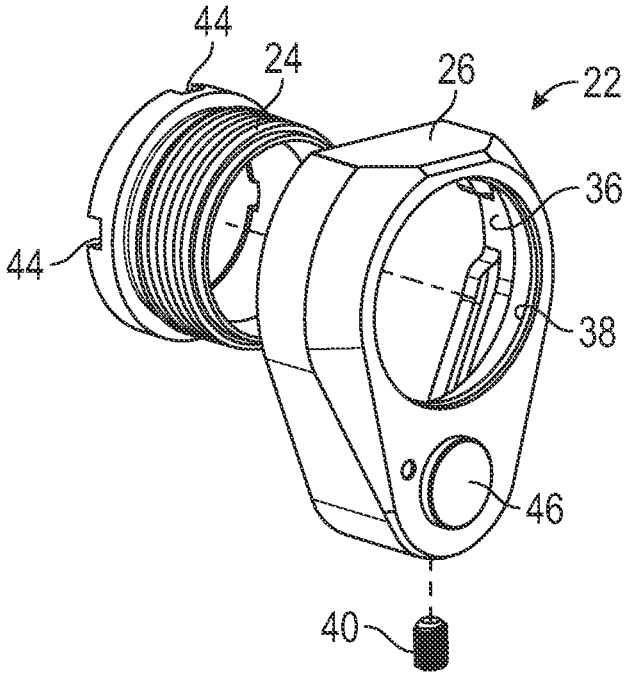

As is shown in FIGS. 2A & B, at least one of the first adapter interface 26 and second adapter interface 32 includes radially protruding lugs 34, and the other defines lugways 36 configured to receive the lugs. In the current embodiment, the first adapter interface defines the lugways, and the second adapter interface includes the radially protruding lugs. The firearm interface 24 of the first adapter portion 22 is a threaded flanged connector received by a threaded central aperture 38 defined by the first adapter portion. A socket head set screw with nylon patch 40 is threadedly received by a threaded aperture 42 perpendicular to and communication with the central aperture. The socket head set screw with nylon patch extends into the central aperture making contact with the outer diameter of the flange of the flanged connector. This prevents the threaded flanged connector from vibrating lose under recoil forces. Four notches 44 defined by the threaded flanged connector are driven by a tool to attach the threaded flanged connector to the rifle 14. As is shown in FIGS. 2A-4B, the first adapter portion also includes a boss 46 that is received by a counterbore 48 for a receiver plate 50 defined by the lower receiver 52 of the rifle 14.

Figure 4A:
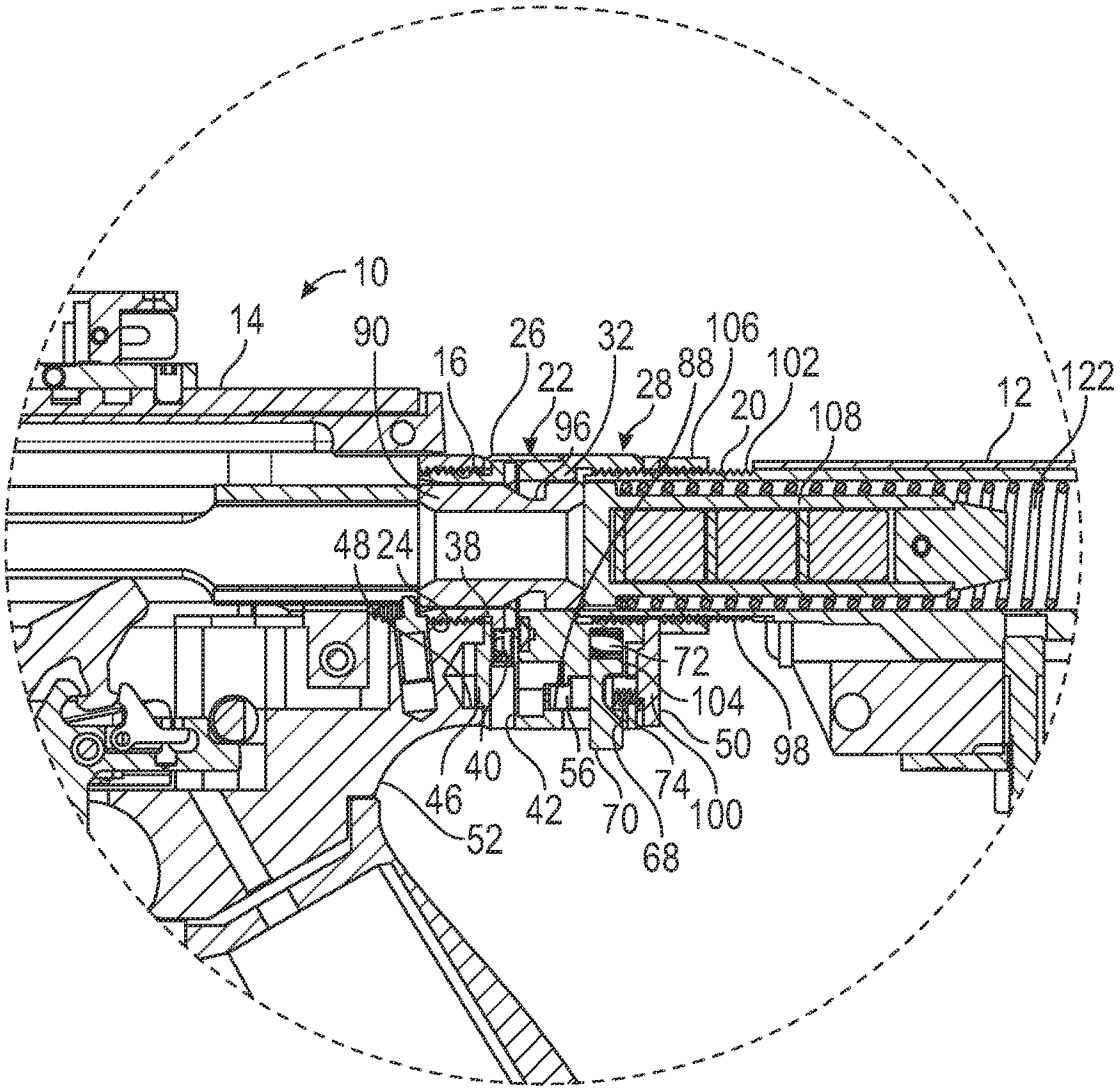
FIG. 4A is an enlarged sectional view of the stock adapter for a firearm of FIG. 1 taken along circle 4A of FIG. 3.

The stock interface 30 of the second adapter portion 28 is a threaded central aperture 54 defined by the second adapter portion. The second adapter portion includes an anti-rotation locking bolt 56 received in an aperture 58 defined by the second adapter portion. The anti-rotation locking bolt defines two apertures 60, 62 that each receive an anti-rotation locking bolt spring 64. The anti-rotation locking bolt also defines a central aperture 66 that is perpendicular to the apertures 60, 62. The second adapter portion defines an aperture 68 that is in communication with the aperture 58. A locking bolt release button 70 and a locking bolt release button spring 72 are received in the apertures 68, 58 in the second adapter portion. The locking bolt release button defines a sloped slot 74 that is received by the central aperture 66 of the anti-rotation locking bolt. The locked and unlocked positions of the anti-rotation locking bolt and the locking bolt release button are shown in FIGS. 4A & B. When the locking bolt release button is depressed, the sloped slot forces the anti-rotation locking bolt rearwards overcoming the anti-rotation locking bolt springs to disengage the anti-rotation locking bolt from a notch 88 defined by the first adapter portion 22. Thus, at least one of the first adapter interface and second adapter interface includes a spring-biased protrusion (the anti-rotation locking bolt) facing the other of the first adapter interface and second adapter interface. A pin 112 is received in an aperture 114 in the second adapter portion and limits the range of motion of the anti-rotation locking bolt.

The second adapter portion 28 also defines a slot 76 that receives a buffer retaining lever 78. The buffer retaining lever is pivotally mounted on the second adapter portion by a coiled pin 80 received in an aperture 116 in the buffer retaining lever. A lever cover plate 82 is releasably secured to the second adapter portion by a flat head screw 84 received in an aperture 118 in the lever cover plate. One end of the coiled pin is received in an aperture 120 in the lever cover plate. The lever cover plate secures a lever spring 86 in contact with the buffer retaining lever. As is shown in FIGS. 7A & B, the buffer retaining lever is a latch movable between a retention position configured to prevent passage of a reciprocating element (a buffer spacer 90) from rearward of the buffer retaining lever, and a released position to enable passage of a reciprocating element from rearward of the buffer retaining lever. The buffer retaining lever is operable to the released position when the first and second adapter interfaces are connected in the locked condition, and to the retention position when the first and second adapter interfaces are separated. The lever spring biases the buffer retaining lever to the retention position. A lower portion 92 of the buffer retaining lever protrudes from the slot 76 so that the user can push on the lower portion to place the buffer retaining lever in the released position to insert and remove the buffer spacer from within the threaded central aperture 54. The buffer spacer is inserted into the threaded central aperture until an upper portion 94 of the buffer retaining lever can engage a groove 96 defined by the buffer spacer to releasably secure the buffer spacer within the central aperture.

Figure 3:
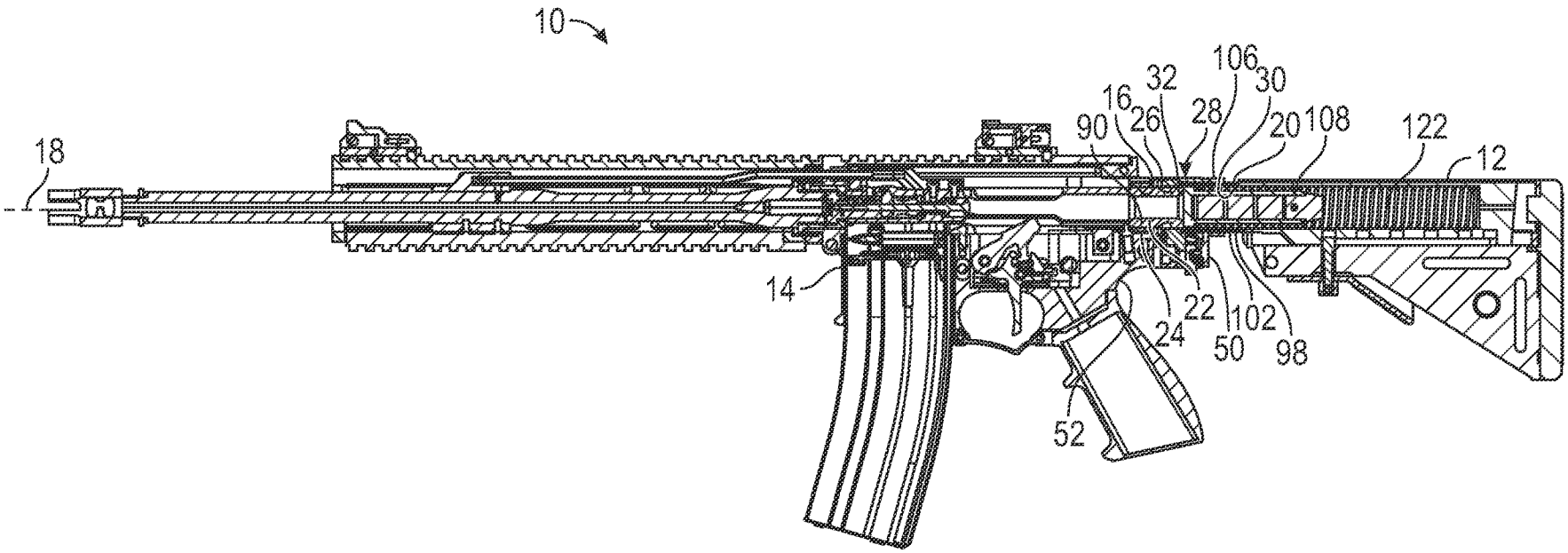
FIG. 3 is a side sectional view of the stock adapter for a firearm of FIG. 1.
Figure 4B:
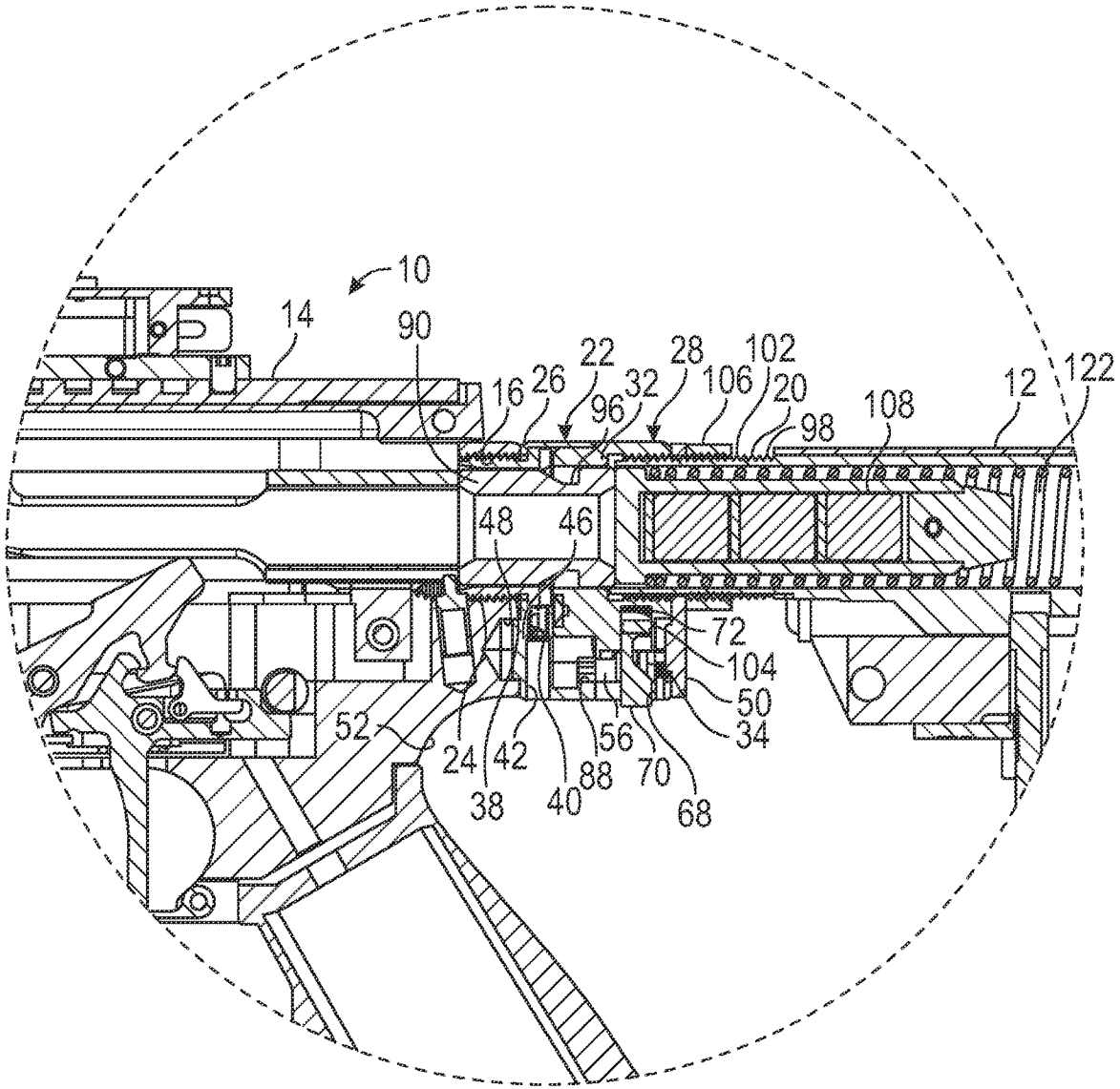
FIG. 4B is an enlarged sectional view of the stock adapter for a firearm of FIG. taken along circle 4A of FIG. 3, but with the button and latch in their alternative positions.

As is shown in FIGS. 3-4B, second adapter portion 28 is attached to 1 3/16×16 male threads 102 on a buffer tube 98 portion of the stock 12 by turning the second adapter portion clockwise until the threads bottom out on the second adapter portion. The second adapter portion is then rotated slightly counterclockwise until a boss 100 on the receiver plate 50 lines up with a counterbore 104 defined by the second adapter portion. Subsequently, the castle nut 106 is tightened to compress the anti-rotation locking bolt springs 64 between the receiver plate and the anti-rotation locking bolt 56 and force the receiver plate to abut the second adapter portion. The buffer tube receives a buffer weight 108.

Once the first adapter portion 22 is connected to the rifle 14 and the second adapter portion 28 is connected to the stock 12, the stock adapter for a firearm 10 is ready to attach the stock to the rifle. To attach the stock to the rifle, the user aligns the radially protruding lugs 34 on the second adapter interface 32 with the lugways 36 defined by the first adapter interface 26. Then, the user applies force from the rear of the stock until the radially protruding lugs enter the lugways. Then, the user rotates the stock clockwise 30° until the stock cannot turn any further.

The anti-rotation locking bolt 56 deploys into the notch 88 defined by the first adapter portion 22, thus locking the first adapter portion 22 and second adapter portion 28 together so they cannot rotate or pull apart. During the clockwise rotation of the stock 12, the lower portion 92 of the buffer retaining lever 78 protruding from slot 76 defined by the second adapter portion is forced against an internal wall 110 of the first adapter portion This compresses the lever spring 86 as the buffer retaining lever pivots on the coiled pin 80, which disengages the upper portion 94 of the buffer retaining lever from the groove 96 defined by the buffer spacer 90. This disengagement enables the buffer spacer and buffer weight to move freely forward and backwards during normal cycling of the rifle 14 and into their proper position under the influence of a recoil spring 122 (shown in FIGS. 3 & 4A) contained within the buffer tube 98. After the first and second adapter portions are securely locked together, the rifle 14 is ready for use. In this condition, the buffer spacer makes contact with the bolt carrier group, which pushes the buffer spacer back slightly. This contact means the buffer retaining lever does not hold the buffer spacer back as soon as the first and second adapter portions are mated.

To remove the stock 12 from the rifle 14, the user depresses the locking bolt release button 70. The locking bolt release button forces the anti-rotation locking bolt rearwards as previously described. While keeping the locking bolt release button depressed, the user rotates the stock counterclockwise until the radially protruding lugs 34 on second adapter interface 32 are aligned with the lugways 36 defined by the first adapter interface 26. The rotation enables the buffer retaining lever 78 to pivot under the influence of the lever spring 86 to reengage the upper portion 94 of the buffer retaining lever with the groove 96 defined by the buffer spacer 90. The buffer spacer, buffer weight 108, and recoil spring 122 are then prevented from coming out of the buffer tube 98 and second adapter portion 28 when the stock and rifle are separated. Thus, the latch (the buffer retaining lever) is operable to the released position when the first and second adapter interfaces are connected in the locked condition, and to the retention position when the first and second adapter interfaces are separated. After the user pulls the rifle and the stock away from each other, the separation of the stock from the rifle is complete.

It should be appreciated that the current invention utilizes straight axial mating and rotation to connect the stock 12 to the rifle 14, which has numerous advantages over the prior art. The axial motions provide a more natural and ergonomic method of attachment, which makes them easier to perform in stressful battle situations. Furthermore, these motions follow the pattern of other more intuitive quick detach mechanisms than the prior art, such as those employed for attaching camera lenses to camera bodies. The ability of the current invention to automatically capture the buffer spacer 90, buffer weight 108, and recoil spring is another significant advantage over the prior art.

Figure 8:
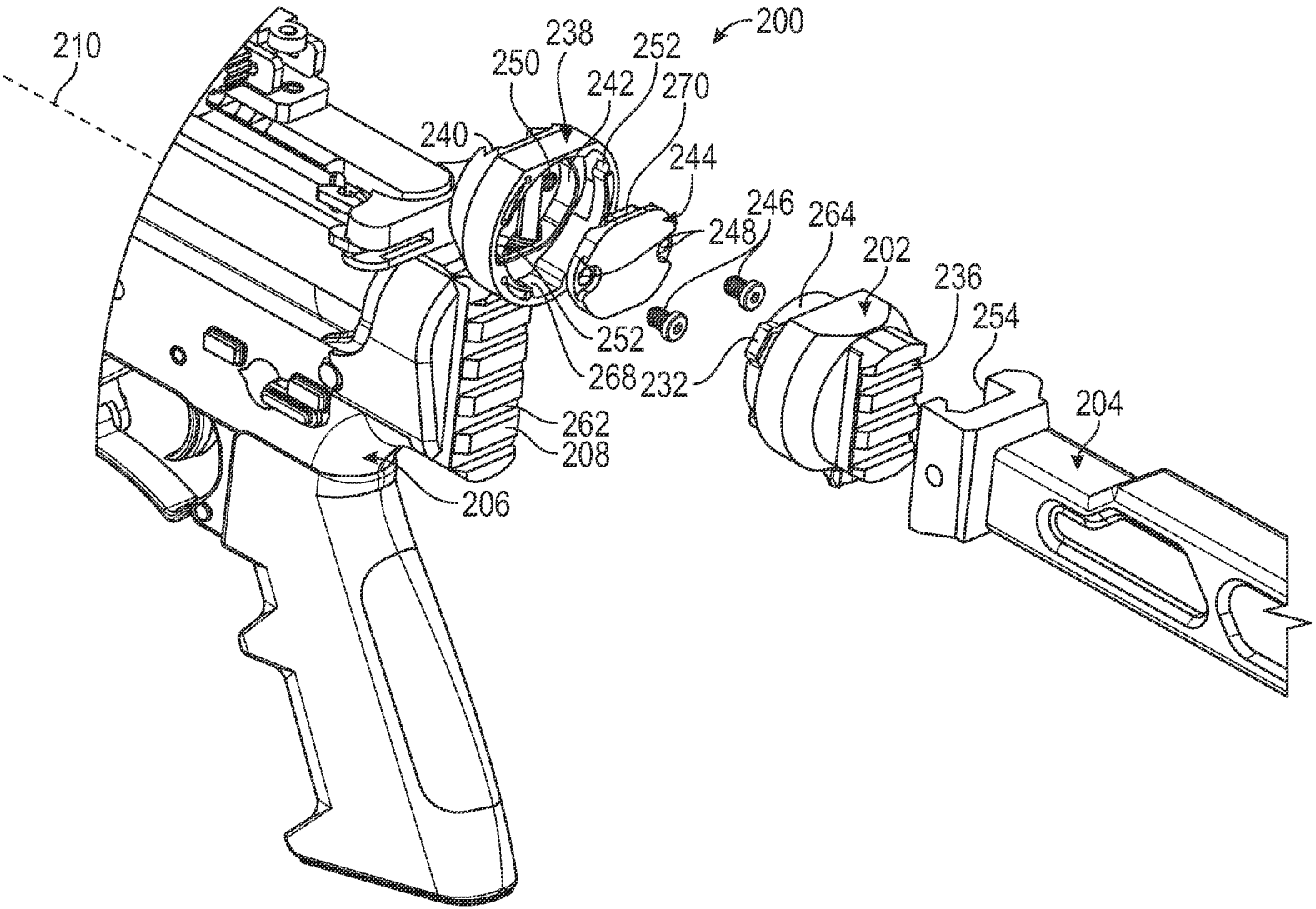
FIG. 8 is a partially exploded view of an alternative embodiment of the stock adapter for a firearm constructed in accordance with the principles of the present invention.
Figure 9:
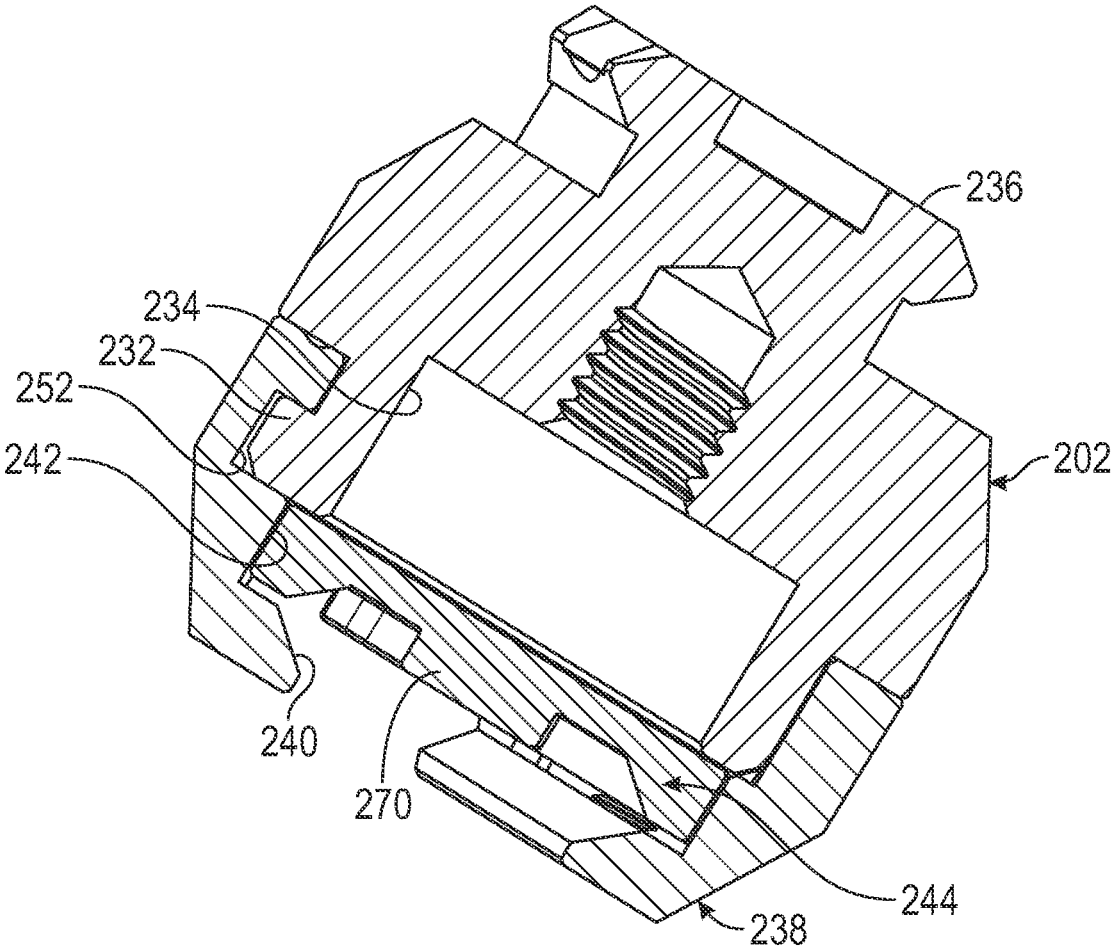
FIG. 9 is a sectional view of the alternative embodiment of the stock adapter for a firearm of FIG. 8.
Figure 10:
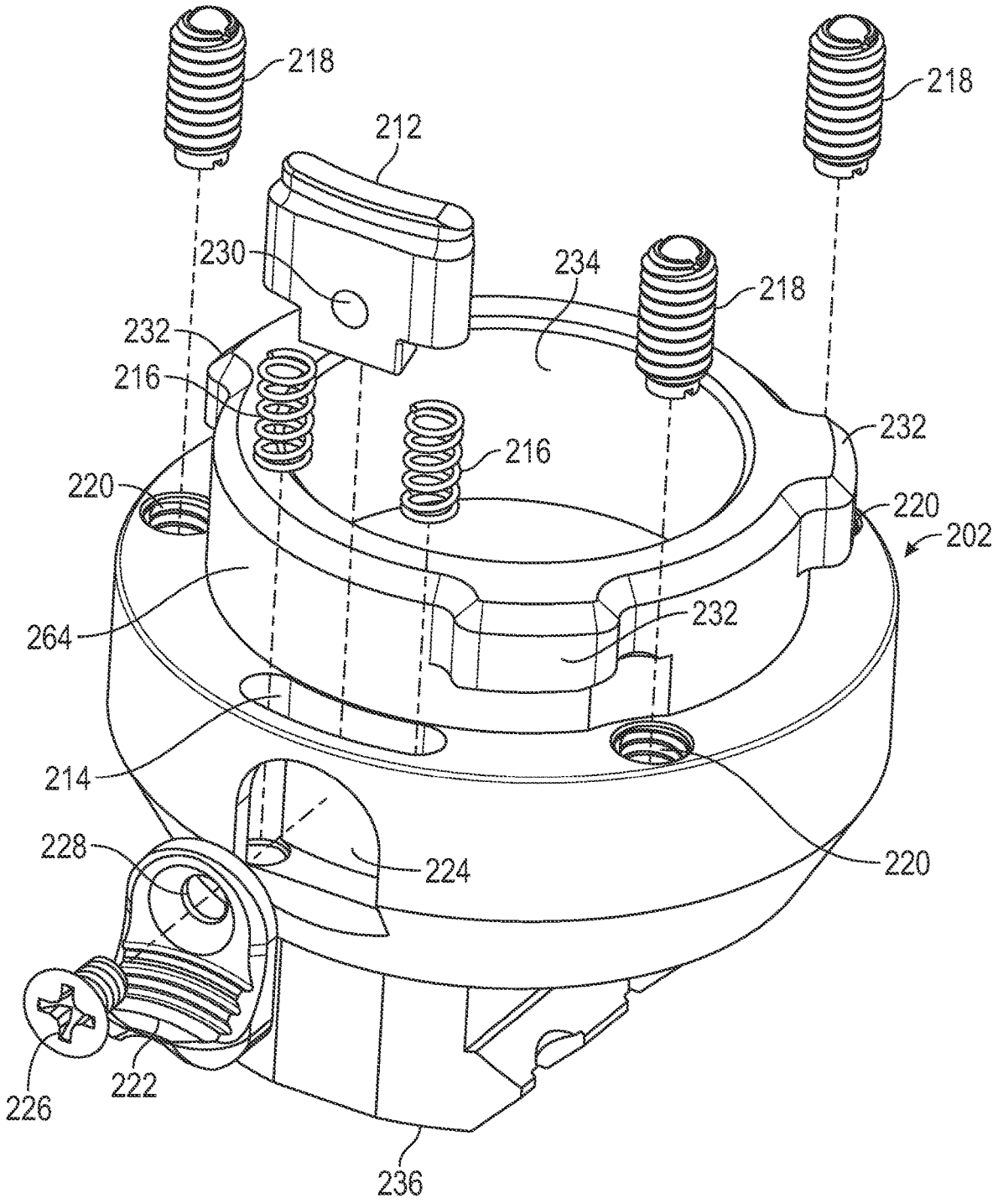
FIG. 10 is an exploded view of the second adapter portion of the alternative embodiment of the stock adapter for a firearm of FIG. 8.
Figure 11:
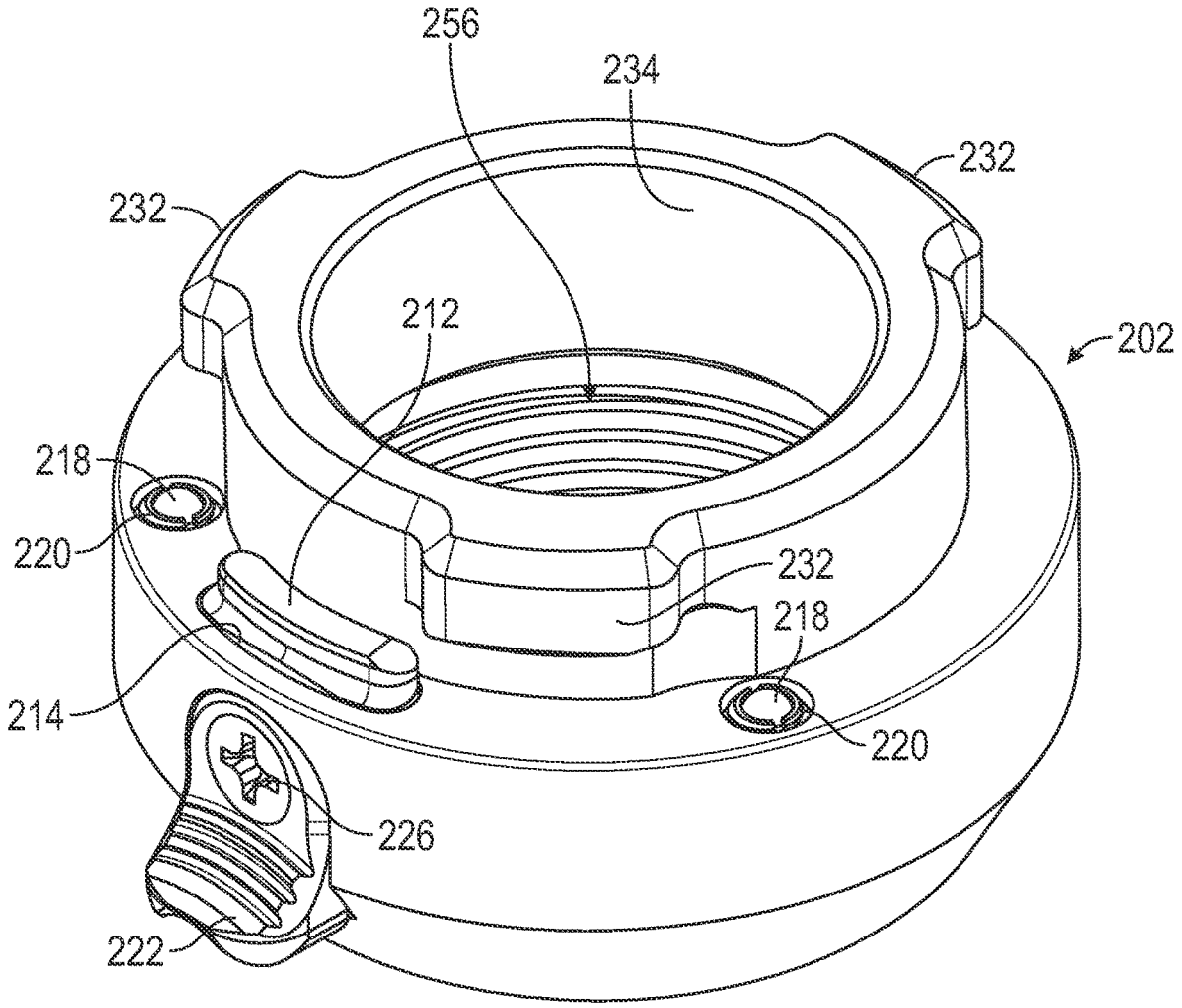
FIG. 11 is a front isometric view of the second adapter portion of the alternative embodiment of the stock adapter for a firearm of FIG. 8.

FIGS. 8 & 9 illustrate an improved alternative embodiment of the stock adapter for a firearm 200, and FIGS. 10 & 11 illustrate a second adapter portion 202 of the alternative embodiment of the stock adapter for a firearm 200. More particularly, FIG. 8 shows how the alternative embodiment of the stock adapter for a firearm 200 connects a stock 204 to a rifle 206 that uses an attachment rail as a stock interface 208. In the current embodiment, the attachment rail is an elongated element transverse to the barrel axis 210.

The second adapter portion 202 includes an anti-rotation locking bolt 212 received by an aperture 214 defined by the second adapter portion, which in turn receives two anti-rotation locking bolt springs 216. Three ball detent screws 218 are received by three threaded apertures 220 defined by the second adapter portion. An anti-rotation locking bolt release tab 222 is received in an aperture 224 in communication with the aperture 214. A release tab screw 226 is received by an aperture 228 defined by the anti-rotation locking bolt release tab and is received by a threaded aperture 230 in the anti-rotation locking bolt to secure the anti-rotation locking bolt release tab to the anti-rotation locking bolt. The second adapter portion also includes radially protruding lugs 232, a central bore 234, and firearm interface 236 in the form of an attachment rail.

To attach the second adapter portion 202 to the stock 204, the firearm interface 236 is inserted into a firearm interface 254 in the form of dovetail slots on the stock, and a screw passes between two lugs 258 on the attachment rail and through apertures 260 in the dovetail slots on the stock to releasably secure the second adapter portion to the stock.

A first adapter portion 238 has dovetail slots 240 on one side and defines a central bore 242 that receives a rail pinch plate 244. The rail pinch plate has protruding lugs 270 on one side. Two screws 246 are received by apertures 248 defined by the rail pinch plate and are threadedly received by two threaded apertures 250 defined by the first adapter portion. The first adapter portion also defines lugways 252 configured to receive the lugs 232 on the second adapter portion 202.

The lugways 252 have a wall thickness of 0.093 inch, which provides a large radius for engaging the lugs 232 that provides strong resistance to bending forces, but in a limited package minimizing protrusion beyond the rifle 206 to prevent snagging on objects in the environment. Thus, the lugs have radial periphery that is a limited distance beyond a second adapter interface 264 of the second adapter portion and do not protrude beyond the second adapter portion. The first and second adapter portions are cylindrical bodies with cylindrical central bores 234, 242 with only the limited protrusion of the anti-rotation locking bolt release tab 222 extending beyond the first and second adapter portions to also prevent snagging on objects in the environment.

To attach the first adapter portion 238 to the stock interface 208, the dovetail slots 240 are slid onto the stock interface. The rail pinch plate 244 is inserted into the central bore 242. Then, the first adapter portion is slid up or down until the protruding lugs on the rail pinch plate are aligned with the rail slots 262 in the stock interface at the desired height. Once alignment is achieved, the screws 246 are used to secure the picatinny rail pinch plate to the first adapter portion, which secures the first adapter portion in place on the stock interface.

Once the first adapter portion 238 is connected to the rifle 206 and the second adapter portion 202 is connected to the stock 204, the alternative embodiment of the stock adapter for a firearm 200 is ready to attach the stock to the rifle. To attach the stock to the rifle, the user aligns the radially protruding lugs 232 on the second adapter interface 264 of the second adapter portion with the lugways 252 defined by a first adapter interface 266 of the first adapter portion. Then, the user applies force from the rear of the stock until the radially protruding lugs enter the lugways. Then, the user rotates the stock clockwise 40° until the stock cannot turn any further.

The anti-rotation locking bolt 212 deploys into a notch 268 defined by the first adapter portion 238, thus locking the first adapter portion 238 and second adapter portion 202 together so they cannot rotate or pull apart. The anti-rotation locking bolt is deployed by being pushed forward by the anti-rotation locking bolt springs 216. After the first and second adapter portions are securely locked together, ball detent screws 218 apply opposing pressure to the first and second adapter portions. This opposing pressure provides a tight and secure hookup that ensures the lugs 232 are unable to wobble in the lugways 252 and prevents rattles, making the rifle 206 ready for use.

To remove the stock 204 from the rifle 206, the user slides the locking bolt release tab 222 rearward. This action moves the anti-rotation locking bolt 212 rearward and out of the deployed position in the notch 268 of the first adapter portion 238. This action also compresses the two anti-rotation locking bolt springs 216. While holding the locking bolt release tab rearward, the stock can be rotated counter-clockwise until the radially protruding lugs 232 on the second adapter portion 202 are aligned with the lugways 252 in the first adapter portion. At this point, the stock is pulled rearward to separate the stock from the rifle. It should be appreciated the alternative embodiment of the stock adapter for a firearm 200 also utilizes straight axial mating and rotation to connect the stock to the rifle, which has the numerous advantages over the prior art previously described. It should also be appreciated that the stock interface can be a threaded bore 256, and the firearm interface 236 can be female threads on the stock.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm. In the context of the specification, the terms "clockwise" and "counterclockwise" have the following definitions: "clockwise" means in the direction in which the hands of a clock rotate as viewed from in front or as if standing on a clock face when the stock adapter for a firearm is viewed from the rear while "counterclockwise" means in a direction opposite to that in which the hands of a clock rotate as viewed from in front when the stock adapter for a firearm is viewed from the rear.

While current embodiments of a stock adapter for a firearm have been described in detail, it should be apparent that modifications and variations thereto are possible, all of which fall within the true spirit and scope of the invention. Although rifles have been disclosed, the stock adapter for a firearm is also suitable for use with pistols, shotguns, light and medium machine guns, and other firearms. Furthermore, the stock adapter for a firearm is also suitable for attaching arm braces to firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A stock adapter for a firearm having a stock interface and defining a barrel axis, and a stock having a firearm interface configured to removably connect to the stock interface, comprising:

a first adapter portion having a firearm interface configured to removably connect to the stock interface of the firearm;

the first adapter portion having a quick detach first adapter interface;

a second adapter portion having a stock interface configured to removably connect to the firearm interface of the stock;

the second adapter portion having a quick detach second adapter interface configured to removably connect to the firearm interface of the stock; and the first adapter interface and second adapter interface being removably joined in an abutting condition, and when in the abutting condition relatively rotatable between an unlocked condition in which the first adapter interface and second adapter interface are axially separable, and a locked condition in which the first adapter interface and second adapter interface are axially inseparable.

2. The adapter of claim 1 wherein the first adapter interface and second adapter interface are rotationally aligned to rotationally interface about the barrel axis.

3. The adapter of claim 1 wherein rotation between the locked condition and unlocked condition is less than one half rotation.

4. The adapter of claim 1 wherein at least one of the first adapter interface and second adapter interface includes radially protruding lugs, and the other defines lugways configured to receive the lugs.

5. The adapter of claim 1 wherein the stock interface is a threaded bore.

6. The adapter of claim 1 wherein the stock interface is an attachment rail.

7. The adapter of claim 6 wherein the attachment rail is an elongated element transverse to the barrel axis.

8. The adapter of claim 1 wherein at least one of the first adapter interface and second adapter interface includes a spring-biased protrusion facing the other of the first adapter interface and second adapter interface.

9. The adapter of claim 1 including a plurality of ball detents biasing apart the first adapter interface and second adapter interface when in the locked condition.

10. The adapter of claim 1 wherein the first adapter portion and second adapter portions have major exterior profiles concentric about the barrel axis.

11. The adapter of claim 1 wherein the second adapter interface includes a latch movable between a retention position configured to prevent passage of a reciprocating element from rearward of the latch, and a released position to enable passage of a reciprocating element from rearward of the latch.

12. The adapter of claim 11 wherein the latch is operable to the released position when the first and second adapter interfaces are connected in the locked condition, and to the retention position when the first and second adapter interfaces are separated.

* * * * *